US005546840A

United States Patent [19]

Supe-Dienes

[11] Patent Number: 5,546,840

[45] Date of Patent: Aug. 20, 1996

[54] SLITTING MACHINE WITH POSITION CHECK OF THE CUTTING EDGES

[75] Inventor: Rudolf Supe-Dienes, Overath, Germany

[73] Assignee: Dienes Werke für Maschinenteile GmbH & Co. KG, Overath-Vilkerath, Germany

[21] Appl. No.: 145,988

[22] Filed: Oct. 27, 1993

[30] Foreign Application Priority Data

Oct. 28, 1992 [DE] Germany ..... 42 36 288.1

[51] Int. Cl.[6] ..... B26D 7/27; B26D 1/14

[52] U.S. Cl. ..... 83/478; 83/508.3; 83/520; 83/522.15; 83/522.23

[58] Field of Search ..... 83/478, 505, 506, 83/507, 508.3, 520, 522.15, 522.22, 522.23, 544, 545, 546, 676, 425.3, 425.4, 563, 564, 504; 1/564

[56] References Cited

U.S. PATENT DOCUMENTS

| | | | |
|---|---|---|---|
| 1,841,867 | 1/1932 | Wiegelmann | 83/508.3 |
| 3,682,027 | 8/1972 | Insolio et al. | 83/676 X |
| 4,041,823 | 8/1977 | Ashbrook | 83/478 |
| 4,161,898 | 7/1979 | Wingen | 83/676 X |
| 4,257,297 | 3/1981 | Nidbella | 83/520 X |
| 4,503,740 | 3/1985 | Brand et al. | 83/520 X |
| 4,532,841 | 8/1985 | Stackhouse, Jr. | 83/478 X |
| 4,570,518 | 2/1986 | Burmeister | 83/505 X |
| 4,649,782 | 3/1987 | Cavagna | 83/425.4 |
| 4,885,967 | 12/1989 | Bell et al. | 83/520 |

FOREIGN PATENT DOCUMENTS

| | | | |
|---|---|---|---|
| 1224277 | 2/1960 | France | 83/676 |
| 1156635 | 10/1963 | Germany | 83/482 |

*Primary Examiner*—Rinaldi I. Rada
*Assistant Examiner*—Clark F. Dexter
*Attorney, Agent, or Firm*—Robert W. Becker & Associates

[57] ABSTRACT

A slitting device has a cutting blade arrangement comprised of a plurality of cutting blade holders each supporting an individual cutting blade. A lifting device is connected to the cutting blade arrangement for lowering the cutting blades against a counter blade for performing a cutting operation and retracting the cutting blades away from the counter blade into a rest position. Each cutting blade holder comprises an indicating device for showing in the rest position a cutting position of the cutting edge relative to the counter blade which cutting position the cutting edge will assume when lowered against the counter blade.

7 Claims, 4 Drawing Sheets

SLITTING MACHINE WITH POSITION CHECK OF THE CUTTING EDGES

BACKGROUND OF THE INVENTION

The present invention relates to a slitting machine or straight-line cutting machine with an arrangement of individual cutting blades supported in individual cutting blade holders that are connected to a common lifting device. The cutting blades are movable into contact with a counter blade.

A slitting machine of the aforementioned kind is known from German Offenlegungsschrift 41 07 227. The prior art slitting machine is provided with a positioning aid for the cutting blade holders that are slidable along a transverse beam and, in a corresponding cutting position, are clampable on the transverse beam. This device already allows for a positioning of the cutting blade holders, with respect to the desired cutting width, at a correct distance to one another. This holds also true, in an embodiment of the counter blade as individual blades or as grooved blade shafts, for the adjustment of the position of the corresponding counter blades.

With the known slitting machine it is disadvantageous that, despite an exactly determined and respectively achieved positioning of the cutting blade holder with the practically achievable precision, during actual operation the individual cutting blades with their cutting edges on approaching the respective counter blade in the form of individual blades may contact the counter blade itself or the cutting blade shaft so that the cutting edges of the cutting blades are damaged thereby reducing or at least impairing the quality of the cutting operation.

It is therefore an object of the present invention to ensure for a slitting machine of the aforementioned kind that at the cutting edges during advancing of the cutting blades toward the counter blade damage to the cutting edges is prevented.

SUMMARY OF THE INVENTION

The slitting device of the present invention is primarily characterized by:

A cutting blade arrangement comprising a plurality of cutting blade holders each supporting an individual cutting blade;

a lifting device connected to the cutting blade arrangement for lowering the cutting blades against a counter blade for performing a cutting operation and retracting the cutting blades away from the counter blade into a rest position; and each cutting blade holder comprising an indicating device for showing in the rest position a cutting position of the cutting blade relative to the counter blade, which cutting position will be assumed by the cutting blade when lowered against the counter blade.

Each cutting blade holder preferably has a protective shield or cover for covering the cutting blade in the rest position. The indicating device includes a slide connected to the cutting blade holder so as to be slidable about a periphery of the cutting blade holder. The slide expediently is a support for an indicator that simulates the cutting position of the cutting blade.

Preferably, the slide has a projection that is positioned in the plane of a cutting edge of the cutting blade and is shaped like the cutting edge.

In an alternative embodiment, the slitting device further comprises an optical fiber connected to the slide, wherein the optical fiber has a light emitting end that is positioned in the plane of the cutting edge of the cutting blade and is shaped like the cutting edge. Preferably, a light source is provided and connected to the cutting blade holder. The optical fiber extends from the protective cover to the cutting blade holder such that light emitted from the light source enters the optical fiber. Expediently, the light source is a laser.

In another embodiment of the present invention, the slitting device further comprises a light source emitting a light beam with a point focus and connected to the cutting blade holder above the cutting blade. The light beam is guided past the cutting blade and divided by the cutting edge of the cutting blade such that a section of the light beam strikes the counter blade. Preferably, the light source is a laser.

In another preferred embodiment of the present invention, the indicating device is a support with an indicator. The support is detachably connected to the cutting blade holder, and the indicator simulates the cutting position of the cutting blade when the support is connected to the cutting blade holder. Preferably, the support comprises a magnetic holder for connecting the support to the cutting blade holder. In an alternative embodiment, the support comprises a mechanical quick coupling for connecting the support to the cutting blade holder.

The principle of the present invention is that the cutting blade holders for the individual cutting blades are provided with an indicating device that in a rest position of the individual cutting blades shows the cutting position that would be assumed by moving the cutting blades toward the counter blade. The present invention has the advantage that, after positioning of the cutting blade holder, it can be checked without operating the cutting blade holder simply by actuating the separate indicating device whether the cutting blades upon actual lowering would be positioned correctly at the counter blade. Should upon controlling the cutting position it be recognized that the cutting edge must be corrected in its position, then it is possible to adjust the position of the cutting blade holder with the possibility of checking whether a required correction lies within the limits of the predetermined positioning of the cutting blade holder. Advantageously, the device may be in the form of a mechanical abutment for the adjustment, respectively, correction of the position of the counter blade.

When the individual cutting blade holders of the slitting machine are provided with a protective cover for covering the cutting blades in their rest position remote from the counter blade, as is in particular described in German patent 38 41 576, an embodiment of the present invention suggests that the device comprise a slide connected to a box-shaped protective cover enclosing the cutting blade so as to be slidable about the periphery of the protective cover. The slide serves as a carrier for an indicator for the position of the cutting blade that would be assumed upon advancing the cutting blade toward the counter blade.

According to a first embodiment of the invention, the slide is provided with a projection that is positioned in the plane of the cutting edge and shaped like the contour of the cutting edge so that it is possible by actuating the slide in the rest position of the individual cutting blade to simulate and thus determine the exact position of the cutting edge at the counter blade and to determine the required correction.

In another embodiment of the present invention the slide is provided with an optical fiber having a light emitting end which is positioned in the plane of the cutting edge and which is shaped like the cutting edge. When the light emitting end is brought into congruence with the position of the cutting edge by sliding the slide, then a defined light beam falls onto the counter blade whereby the light beam indicates the position to be assumed by the cutting edge upon lowering toward the counter blade the individual cutting blades. With this measure it is possible to check the future position of the cutting edge and correct it.

For this purpose it is suggested that the optical fiber is guided from the protective cover to the cutting blade holder and that the cutting blade holder is provided with a light source that emits light into the optical fiber. Preferably, the light source is a laser. The red laser light allows for an especially good visibility of the future position of the cutting edge.

In the alternative it may be provided that a light beam with a point focus is arranged at the cutting blade holder above the individual cutting blades such that the cutting edge of the cutting blades allows passage of a semi-circular section of the emitted light beam to the counter blade. When the corresponding edge of the section of the light beam is adjacent to the cutting edge of the counter blade it is ensured that during lowering of the cutting blade it will not impact on the cutting edge, respectively, the edge portion of the counter blade.

In a further embodiment which is especially suitable for cutting blade holders without a protective cover, it is suggested that the indicating device is comprised of a separate detachable support connectable to the cutting blade holder, respectively, a portion of the cutting blade holder. The support has connected thereto an indicator showing the position of the cutting edge to be assumed in the lowered position of the individual cutting blade. Preferably, the support with indicator is connectable with a magnetic holder or, alternatively, with a mechanical quick coupling, preferably a spring-actuated quick coupling, to the cutting blade holder. This embodiment requires that the indicator must be adjustable to the constructive requirements of the cutting blade holder with respect to the position of the cutting edge because the indicator is preferably laterally connected to the cutting blade holder and must bridge the lateral distance of this holder relative to the cutting edge.

Without deviating from the principle of the invention it is understood that the device for making visible the position of the cutting edge, depending on the design of the upper and lower cutting blade arrangements of a slitting machine, can be coordinated with an upper blade as well as a lower blade arrangement.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
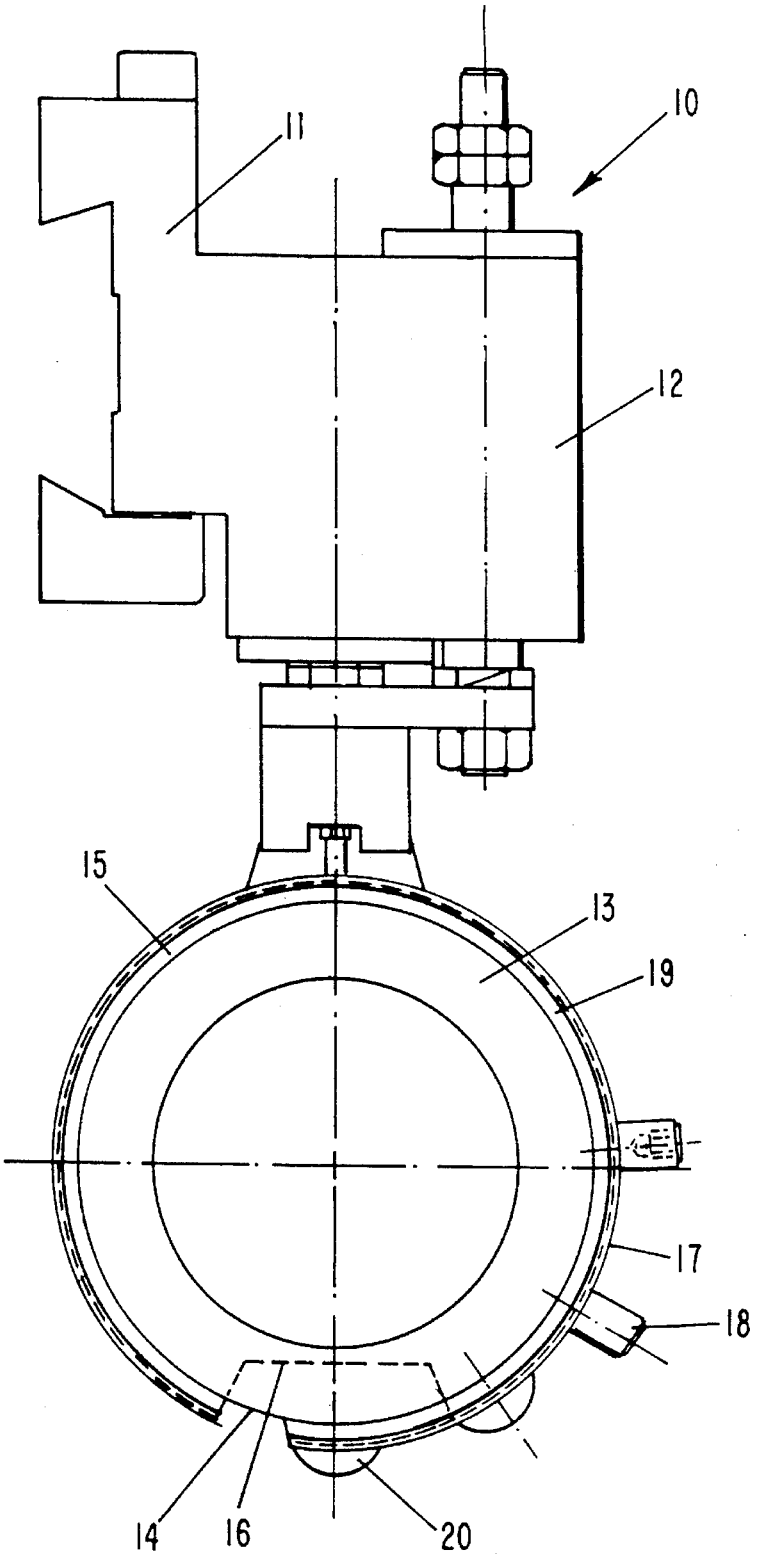
FIG. 1 shows an inventive cutting blade holder in a side view with the device for determining the position being actuated.

The present invention will now be described in detail with the aid of several specific embodiments utilizing FIGS. 1 through 4.

The representation in the drawings is limited to illustrating one individual cutting blade holder that is to be connected to a transverse beam of a slitting machine. The cutting blade holder 10 that is illustrated in FIG. 1 is clamped with a clamping device 11 to a transverse beam B of a slitting machine and is provided with a lowering and lifting device 12 with which a circular cutting blade 13 with its cutting edge 14 can be lowered from its rest position into a cutting position with respect to a non-represented counter blade.

The individual cutting blade 13 is surrounded by a box-shaped protective cover 15 which covers the cutting blade 13. The protective cover 15 is provided with a cutout section 16 at its lower end for allowing penetration of the cutting edge 14 of the circular cutting blade 13 in its cutting or operating position. About the periphery of the protective cover 15 a slide 17 is slidably guided within a recess 19. The slide 17 is displaceable with a grip 18 projecting past the periphery of the protective cover 15. The slide 17 is provided with a projection 20 which extends in the plane of the cutting edge 14 of the circular blade 13. The projection 20 has the shape of a section of the cutting edge 14 i.e., is rounded and essentially semicircular with a width that substantially matches the width of the cutting edge (see FIGS. 1 and 2).

FIG. 1 shows in a solid line the position of the slide 17 in which a positioning check for the cutting blade 13, respectively, its cutting edge 14, is possible. The dash-dotted line represents the position of the slide 17 in which the cutout section 16 of the protective cover 15 is uncovered so that the advancing movement of the cutting blade 13 can be performed without obstruction by the slide 17. Preferably, the slide 17 within the recess 19 may be movable against the force of a spring which prestresses the slide 17 into a position in which the cutout 16 of the protective cover 15 is unobstructed.

Figure 2:
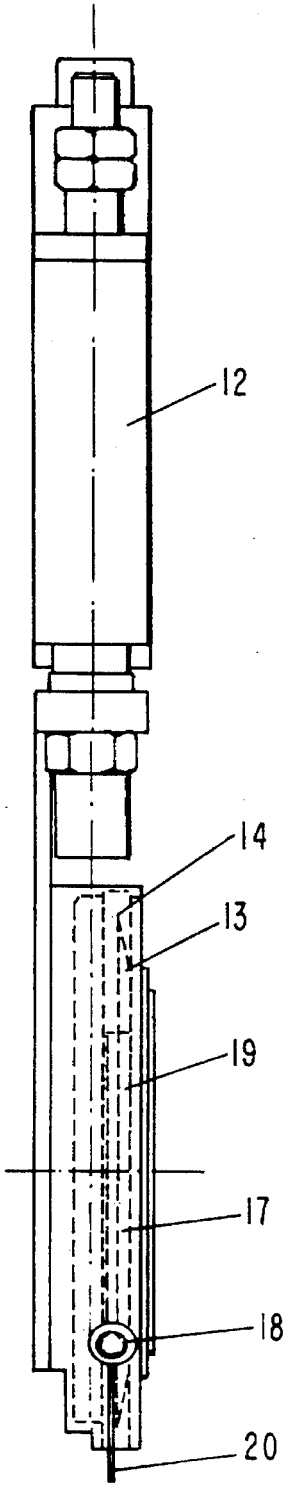
FIG. 2 shows the cutting blade holder according to FIG. 1 in an end view.
Figure 3:
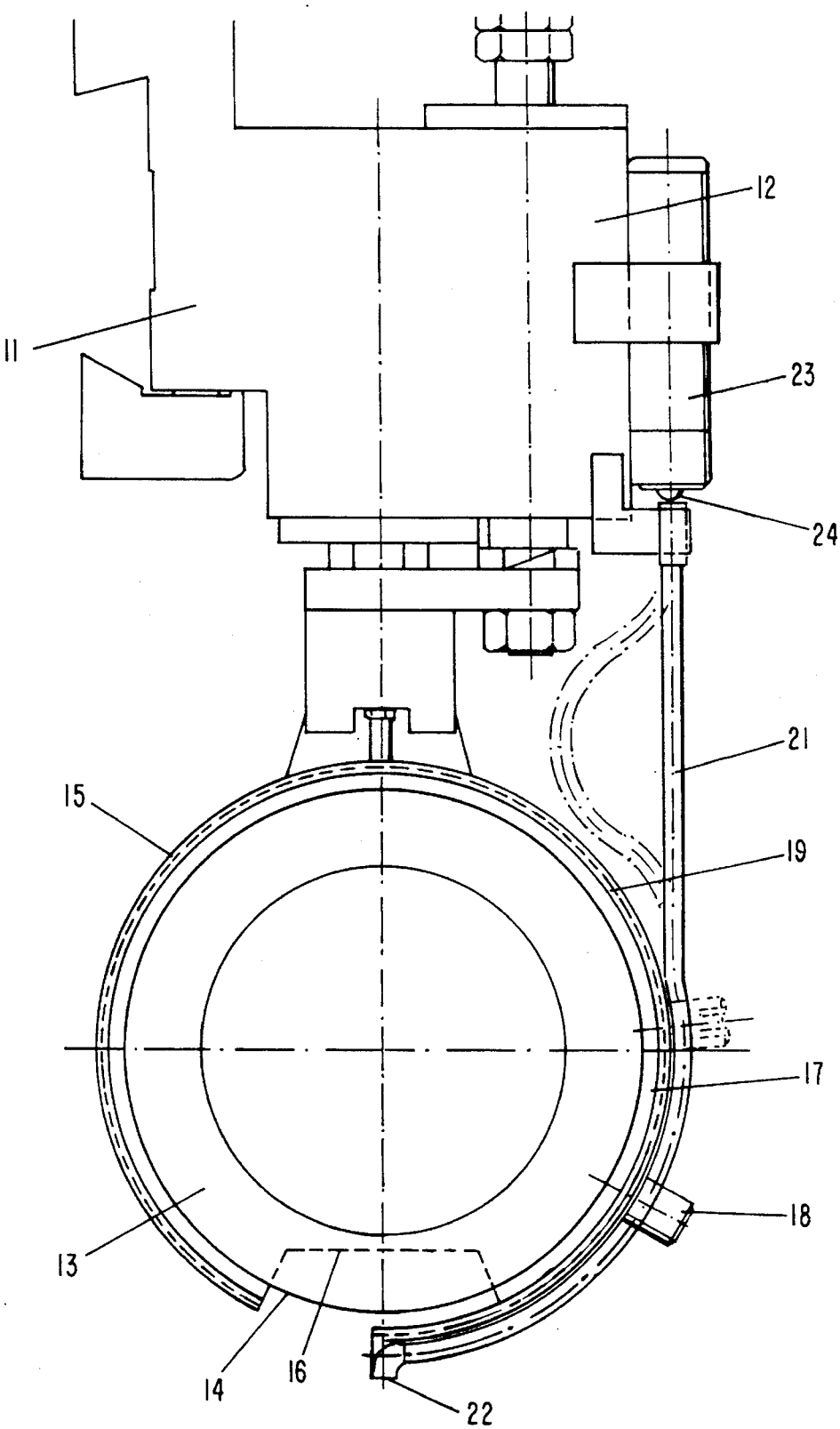
FIG. 3 shows another embodiment of the cutting blade holder according to FIG. 1.

The embodiment represented in FIG. 3 corresponds to the embodiment represented in FIGS. 1 and 2 with the exception that to the slide 17 a flexible optical fiber 21 is connected having a light emitting end 22 which is positionable within the plane of the cutting edge 14. The flexible optical fiber 21 is guided from the slide 17, along the protective cover 15 of the cutting blade holder 10 to a light source in the form of a laser 23 connected to the lifting device 12 whereby the laser 23 emits light via a lens 24.

In an alternative to the embodiment shown in FIG. 3, it is suggested that the cutting blade holder 10 above the cutting blade 13 is provided with a light source having a light beam emission with a point focus whereby the emitted light beam is guided past the cutting blade 13 such that the cutting blade edge 13 divides a semi-circular section from the light point so that only this section is visible on the corresponding counter blade. When the respective edge of this section, which illustrates the position of the cutting edge 14, is positioned adjacent to the cutting edge of the counter blade, it is thus ensured that during lowering of the circular cutting blade 13 the blade 13 does not impact on the counter blade, specifically, the cutting edge of the counter blade.

Figure 4:
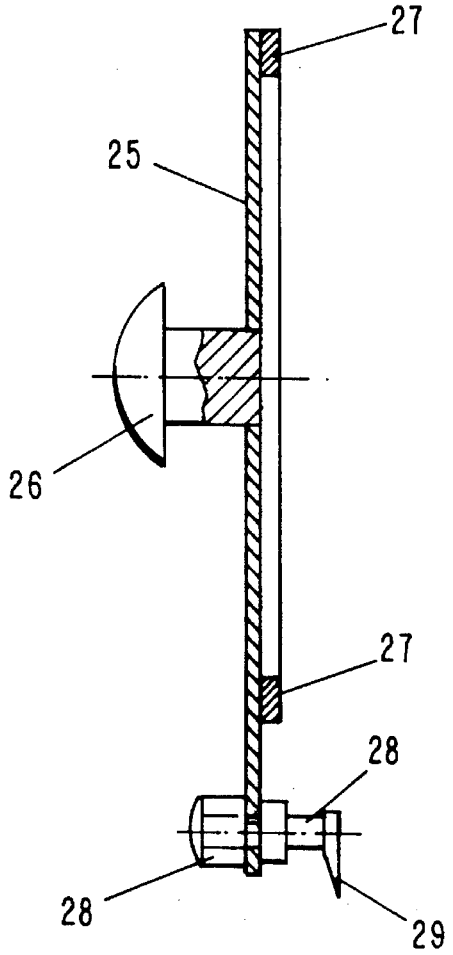
FIG. 4 shows a detachable support with indicator in a side view.
Figure 5:
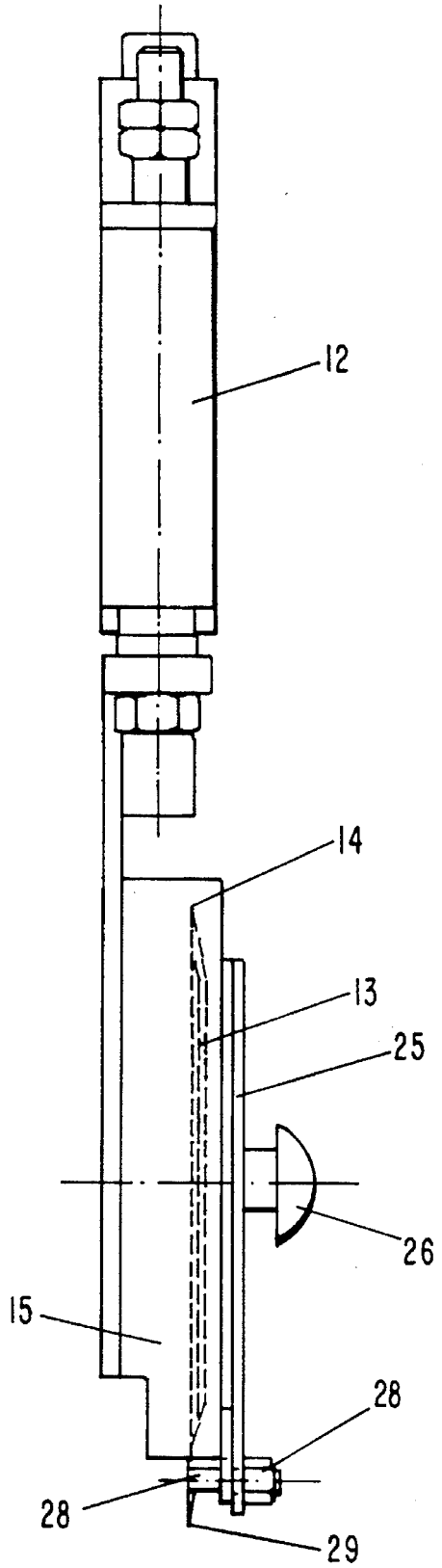
FIG. 5 shows the support of FIG. 4 attached to the protective cover of the blade holder.
Figure 6:
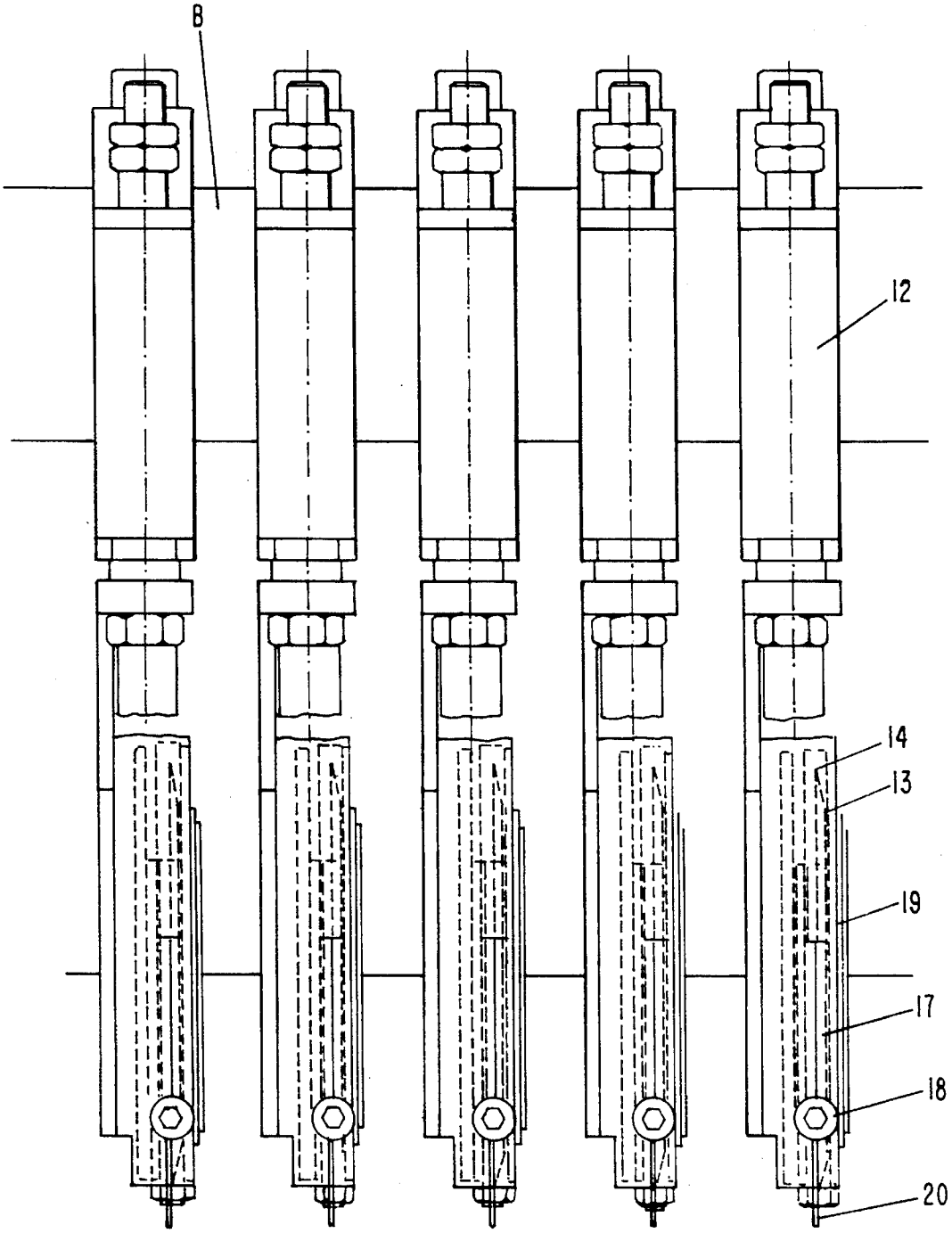
FIG. 6 shows the arrangement of a plurality of blade holders on a transverse beam.

FIG. 4 shows an exchangeable support 25 which is detachably connected to the cutting blade holder 10 with its projection 26. On the side of the support 25 remote from the projection 26 a ring 27 is arranged which is comprised of a permanent magnet so that the support 25 can be attached with the permanent magnet to the actual holder 10 of the blade 13, for example, from the right side as in the representation of FIG. 5. It is also possible that the support 25 is attached laterally to the protective cover 15 if such a protective cover is present. Alternatively, the permanent magnet ring 27 can also be replaced by a number of individual magnets connected to the support 25.

At its lower end, the support 25 is provided with a bolt 28 that at its free end has an indicator 29 that is shaped substantially like the cutting edge. The bolt 28 bridges the lateral distance resulting from the attachment of the support 25 to the cutting blade holder 10 so that the indicator 29 having the shape of the cutting edge indicates the position of the cutting edge that it would assume in its lowered position. Thus, the correct position of the cutting blade holder can be checked. In order for the support 25 to be adaptable to different width of cutting blade holders 10, the lateral distance to be bridged between the support 25 and the position of the indicator 29 can be adjusted with the bolt 28.

The present invention is, of course, in no way restricted to the specific disclosure of the specification and drawings, but also encompasses any modifications within the scope of the appended claims.

What I claim is:

1. A slitting device comprising:

a cutting blade arrangement comprising a plurality of cutting blade holders laterally arranged, each cutting blade holder supporting an individual cutting blade;

a lifting device connected to each of said cutting blade holders for lowering said cutting blades in a first direction against a counter blade for performing a cutting operation and retracting said cutting blades away from the counter blade into a rest position;

each said cutting blade holder comprising an indicating device for showing, when said cutting blade is in said rest position a cutting position in a plane perpendicular to said first direction of said cutting blade relative to said counter blade, which said cutting blade will assume when lowered against the counter blade;

wherein each said cutting blade holder has a protective cover for covering said cutting blade in said rest position;

wherein said indicating device includes a slide which is slidably connected to said protective cover so as to be slidable about a periphery of said protective cover; and wherein said slide comprises an indicator that indicates said cutting position of said cutting blade.

2. A slitting device according to claim 1, wherein said indicator is a projection extending from said slide, said projection positioned in the plane of a cutting edge of said cutting blade.

3. A slitting device according to claim 1, wherein said indicator comprises an optical fiber with a light emitting end positioned in the plane of a cutting edge of said cutting blade wherein the light emitted by the light emitting end shines onto the counter blade and indicates said cutting position of said cutting blade.

4. A slitting device according to claim 3, wherein said indicating device further comprises a light source connected to said cutting blade holder and wherein said optical fiber extends about the periphery of said protective cover to said light source such that light emitted from said light source enters said optical fiber.

5. A slitting device according to claim 4, wherein said light source is a laser.

6. A slitting device comprising:

a cutting blade arrangement comprising a plurality of cutting blade holders each supporting an individual cutting blade;

a lifting device connected to each of said cutting blade holders for lowering said cutting blades against a counter blade for performing a cutting operation and retracting said cutting blades away from the counter blade into a rest position;

each said cutting blade holder comprising an indicating device for showing, when said cutting blade is in said rest position, a cutting position of said cutting blade relative to said counter blade, which said cutting blade will assume when lowered against the counter blade; and said indicating device comprising a support and an indicator connected to said support, said support detachably connected to said cutting blade holder and said indicator indicating said cutting position of said cutting blade when said support is connected to said cutting blade holder.

7. A slitting device according to claim 6, wherein said support comprises a magnetic holder detachably connecting said support to said cutting blade holder.

* * * * *